US006318331B1

(12) United States Patent
Hiraoka et al.

(10) Patent No.: US 6,318,331 B1
(45) Date of Patent: Nov. 20, 2001

(54) LUBRICATION SYSTEM FOR DIRECT INJECTED ENGINE

(75) Inventors: Noriyoshi Hiraoka; Kazutoshi Takashima, both of Hamamatsu (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/376,793

(22) Filed: Aug. 18, 1999

(30) Foreign Application Priority Data

Aug. 18, 1998 (JP) ..... 10-231246

(51) Int. Cl.[7] ..... F01M 1/00
(52) U.S. Cl. ..... 123/196 R; 123/196 W
(58) Field of Search ..... 123/196 W, 196 CP, 123/196 R

(56) References Cited

U.S. PATENT DOCUMENTS

Re. 32,620 * 3/1988 Iwai ..... 123/196 W
4,372,258 * 2/1983 Iwai ..... 123/196 W
4,579,093 * 4/1986 Eanes ..... 123/196 CP
4,599,979 * 7/1986 Breckenfeld et al. ..... 123/196 W
5,193,500 * 3/1993 Haft ..... 123/196 CP
5,513,608 * 5/1996 Takashima et al. ..... 123/196 W
5,537,959 7/1996 Ito .
5,915,350 6/1999 Suzuki et al. .
6,058,900 * 5/2000 Kusche et al. ..... 123/196 W
6,067,952 * 5/2000 Andrasko et al. ..... 123/196 W

* cited by examiner

*Primary Examiner*—Willis R. Wolfe
*Assistant Examiner*—Jason Benton
(74) *Attorney, Agent, or Firm*—Knobbe, Martens, Olson & Bear, LLP

(57) ABSTRACT

A lubrication system for a direct injected two-cycle engine is disclosed having a lubricant pump adapted to discharge lubricant into each crankcase chamber of the engine through a port positioned immediately adjacent the downstream side of reed valves of the air intake system. The lubricant is injected in a direction generally coincident with the rotational direction of the crankshaft. Drain ports are positioned in the lowermost scavenge passage of each cylinder and communicate lubricant from the scavenge passage to a return port formed through the wall of a crankcase chamber.

38 Claims, 8 Drawing Sheets

LUBRICATION SYSTEM FOR DIRECT INJECTED ENGINE

RELATED APPLICATIONS

This invention claims priority to Japanese Application No. 10-231246, which was filed on Aug. 18, 1998.

BACKGROUND OF THE INVENTION

1. Field of the Invention

This invention relates to an engine lubricating system and has particular applicability to a fuel injected two cycle engine.

2. Description of the Related Art

Two cycle internal combustion engines are typically lubricated by supplying lubricant through the engine's induction and porting system for lubricating the various moving components of the engine. Lubricant can be supplied in a wide variety of manners. For example, lubricant may be mixed with fuel, may be sprayed into the induction system of the engine, may be delivered directly to certain components of the engine, or may be supplied by any combination of the above.

In conventional two cycle engines, air from an air intake system travels through reed valves into a crank chamber of the engine. Air from the crank chamber is supplied to the cylinders for combustion. Typically, fuel such as gasoline is mixed with lubrication oil and supplied to the air flow on an upstream side of the reed valves. The viscosity of this fuel/lubricant mixture is low in comparison with a typical lubricant taken alone. Because of its low viscosity, the mixture is easily sprayed and distributed to various parts of the engine for lubrication.

In order to reduce unburned hydrocarbons and engine exhaust emissions, many internal combustion engines now employ direct fuel injection, wherein the fuel is directly injected into the cylinders. In these engine arrangements, the fuel is not mixed with lubricant. As a result, the viscosity of the lubricant is increased and the lubricant is not smoothly sprayed and distributed. Due to its heavy viscosity, when lubricant is supplied upstream of the reed valves, lubricant particles tend to stick together when passing through the valves. The large particles increase lubricant inconsistency, possibly preventing even distribution of lubricant over the engine components.

Lubricant in the crankcase chamber is distributed to the various components of the engine, for instance the pistons and cylinder areas. In two cycle engines, lubricant also typically flows into the scavenging passages. At least some of the lubricant that collects in the scavenge passages may flow into a cylinder combustion chamber and be at least partially burned. Invasion of oil into the combustion chamber at least partially defeats the purpose of fuel injection by contributing additional hydrocarbon exhaust emissions, which direct fuel injection is intended to reduce.

In outboard motor applications, the engine is normally positioned with its cylinders extending horizontally and crankshaft rotating about a vertically extending axis. As is typical with two cycle engines, each crankcase chamber is sealed from the other. However, the seals may permit some leakage from the uppermost crankcase chamber to the lowermost chamber and lubricant may tend to collect in the lowermost portions of the engine. This can cause inadequate lubrication in the uppermost portions and oil overflow in the lower portions. Performance of the engine is decreased.

SUMMARY OF THE INVENTION

Accordingly, there is a need in the art for a two cycle fuel injection engine lubrication system adapted to evenly distribute lubricant to the moving components of the engine, to drain lubricant that may accumulate in scavenge passages, and to prevent excess oil from accumulating in the lowermost portions of the engine.

In accordance with one aspect of the present invention, an internal combustion engine is provided having at least one variable volume combustion chamber. The combustion chamber is defined by at least a pair of components that move relative to each other. A crankcase encloses a crankshaft and has an air guide. The air guide communicates with an air intake device through a valve that regulates air flow into the crankcase. The air guide also has a lubricant insertion port immediately adjacent a downstream side of the valve.

Another aspect of the present invention involves an internal combustion engine having at least one variable volume combustion chamber. The combustion chamber is defined by at least a pair of components that move relative to each other. A crankcase encloses a crankshaft and has an air guide which communicates with an air intake device through a valve that regulates air flow into the crankcase. The crankcase further includes means for inserting lubricant immediately adjacent a downstream side of the valve and means for distributing lubricant in the crankcase.

In a still further aspect of the present invention, an internal combustion engine is provided having at least one variable volume combustion chamber. The combustion chamber is defined by at least a pair of components that move relative to each other. A crankcase encloses a crankshaft therein. The crankcase has an air guide which communicates with an air inlet device and conducts a flow of air into the crankcase. A scavenge system supplies supply air from the crankcase to the combustion chamber. The scavenge system includes means for conducting lubricant way from the scavenge system.

The above-discussed aspects of the invention are particularly well suited with engines operating on a crankcase compression, two-cycle combustion principle; however, many of the disclosed aspects of the invention can also be used with engine types that operate on other combustion principles.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, those skilled in the art will recognize that the invention may be embodied or carried out in a manner that achieves or optimizes one advantage or group of advantages as taught herein without necessarily achieving other objects or advantages as may be taught or suggested herein.

All of these aspects and features are intended to be within the scope of the invention herein disclosed. These and other aspects, features and advantages of the present invention will become readily apparent to those skilled in the art from the following detailed description of the preferred embodiment having reference to the attached figures, the invention not being limited to the particular preferred embodiment disclosed.

DETAILED DESCRIPTION OF THE PREFERRED EMBODIMENT

Figure 1:
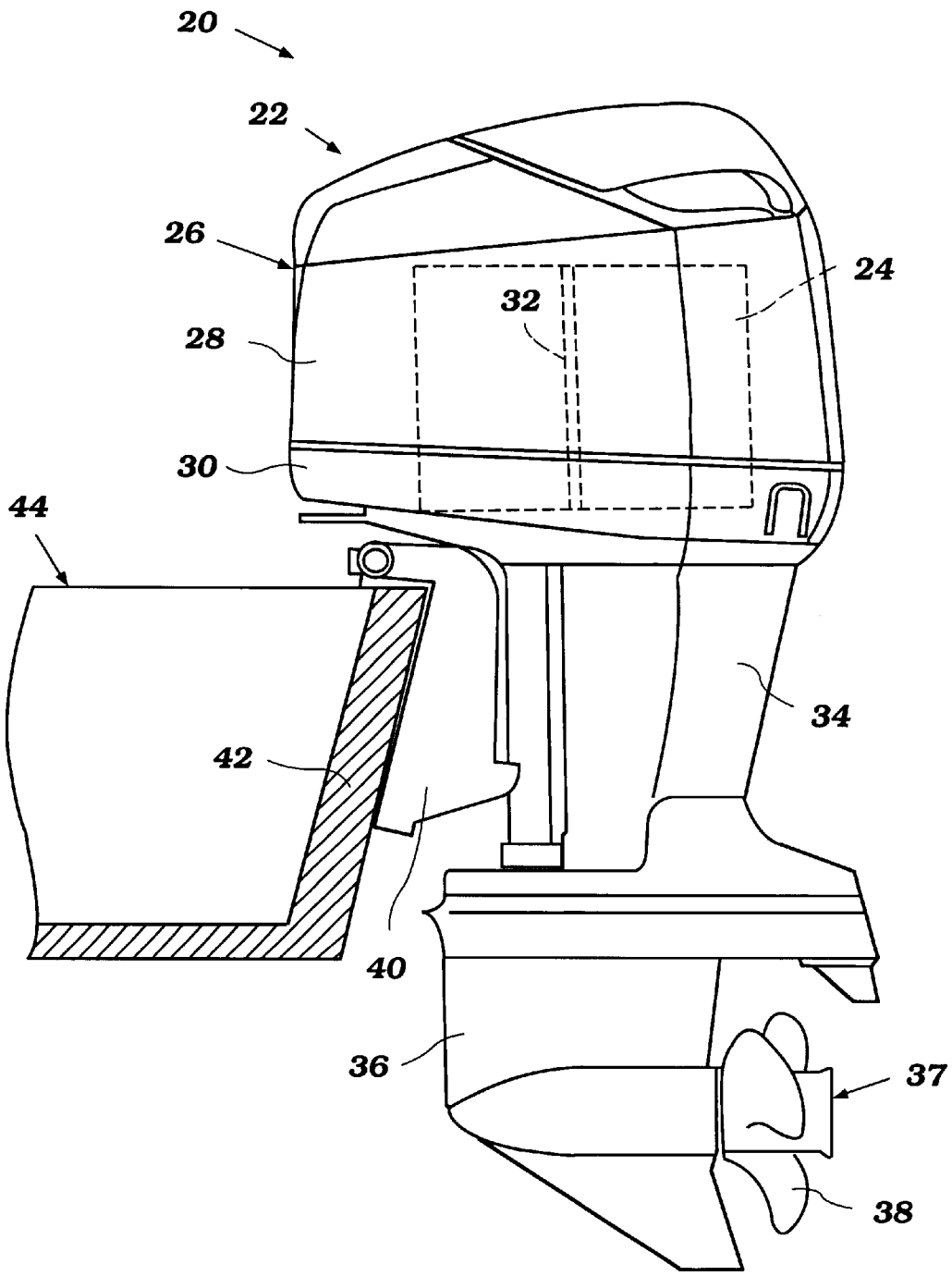
FIG. 1 is a side elevational view of an outboard motor including an engine having features in accordance with an embodiment of the invention, shown attached to the transom of a watercraft (shown partially and in cross-section).

With initial reference to FIG. 1, an outboard motor 20 that includes an engine constructed in accordance with an embodiment of the invention is illustrated. The present invention is herein described in conjunction with such an outboard motor for explanation of an environment in which the invention may be employed. Outboard motors often use two cycle internal combustion engines having output shafts that rotate about a vertical axis. Although the present engine has particular applicability with this arrangement, it is to be understood that the invention may be employed with engines having other orientations and applications, and which operate on other combustion principles.

The outboard motor 20 includes a power head 22 which includes an internal combustion engine 24 enclosed within a protective cowling 26. The cowling comprises an upper cowling member 28 and a lower cowling member 30.

As is typical with outboard motor practice, the engine 24 is supported within the power head 22 so that its output shaft 32 rotates about a vertical axis. The crankshaft 32 is coupled to a drive shaft (not shown) that depends through and is journalled within a drive shaft housing 34.

The drive shaft housing 34 extends downward from the cowling 26 and terminates in a lower unit 36. The transmission selectively establishes a driving condition of a propulsion device 37. In the illustrated embodiment, the propulsion device 37 is a propeller having a plurality of propeller blades 38. The transmission desirably is a forward/neutral/reverse-type transmission so as to drive the watercraft in any of these operational states.

The outboard motor 20 further preferably includes a mount bracket 40 by which it is mounted onto a transom 42 of a watercraft 44.

Figure 2:
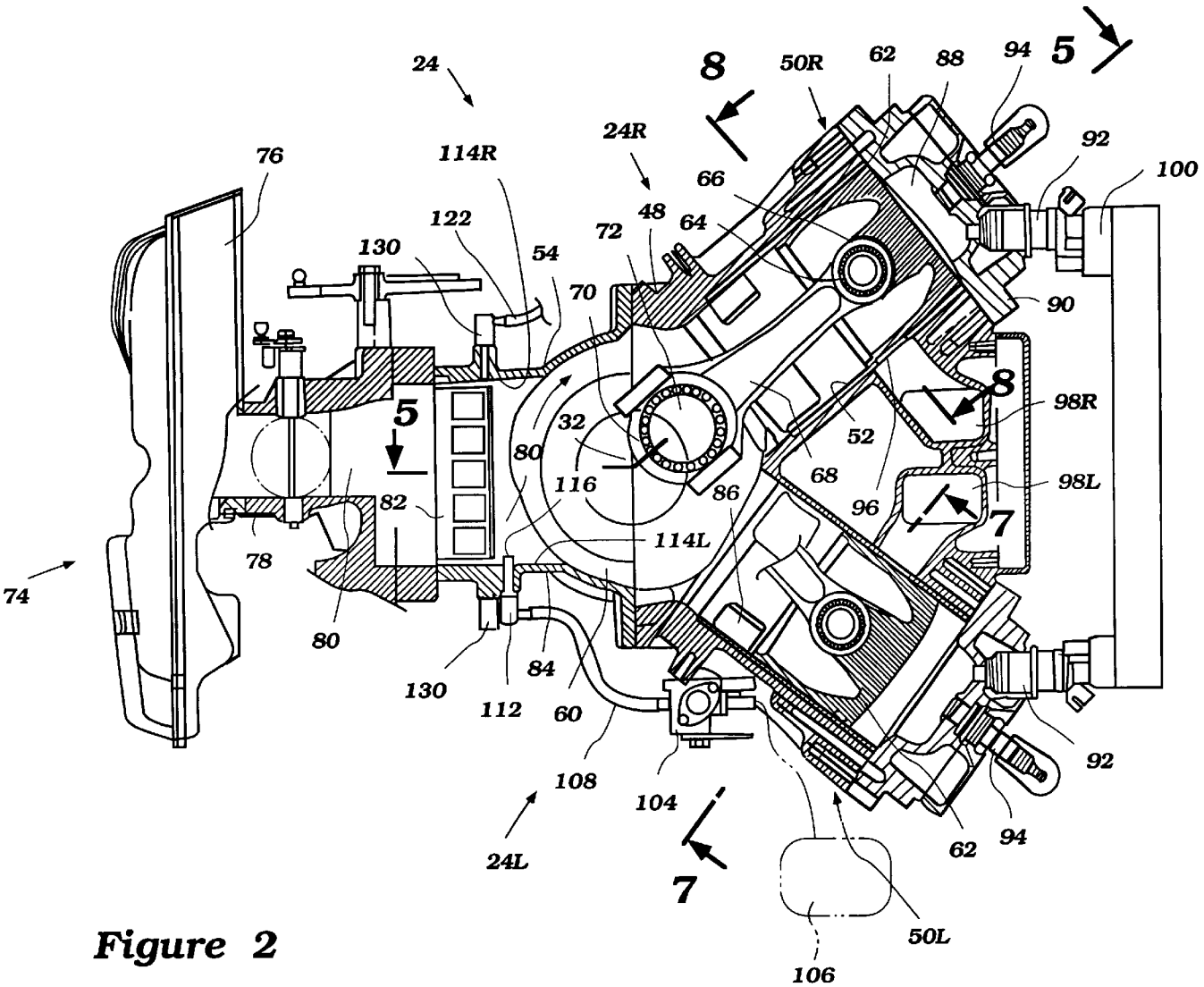
FIG. 2 is a cross-sectional view taken through the cylinders of an engine isolated from an outboard motor having features in accordance with the present invention.
Figure 3:
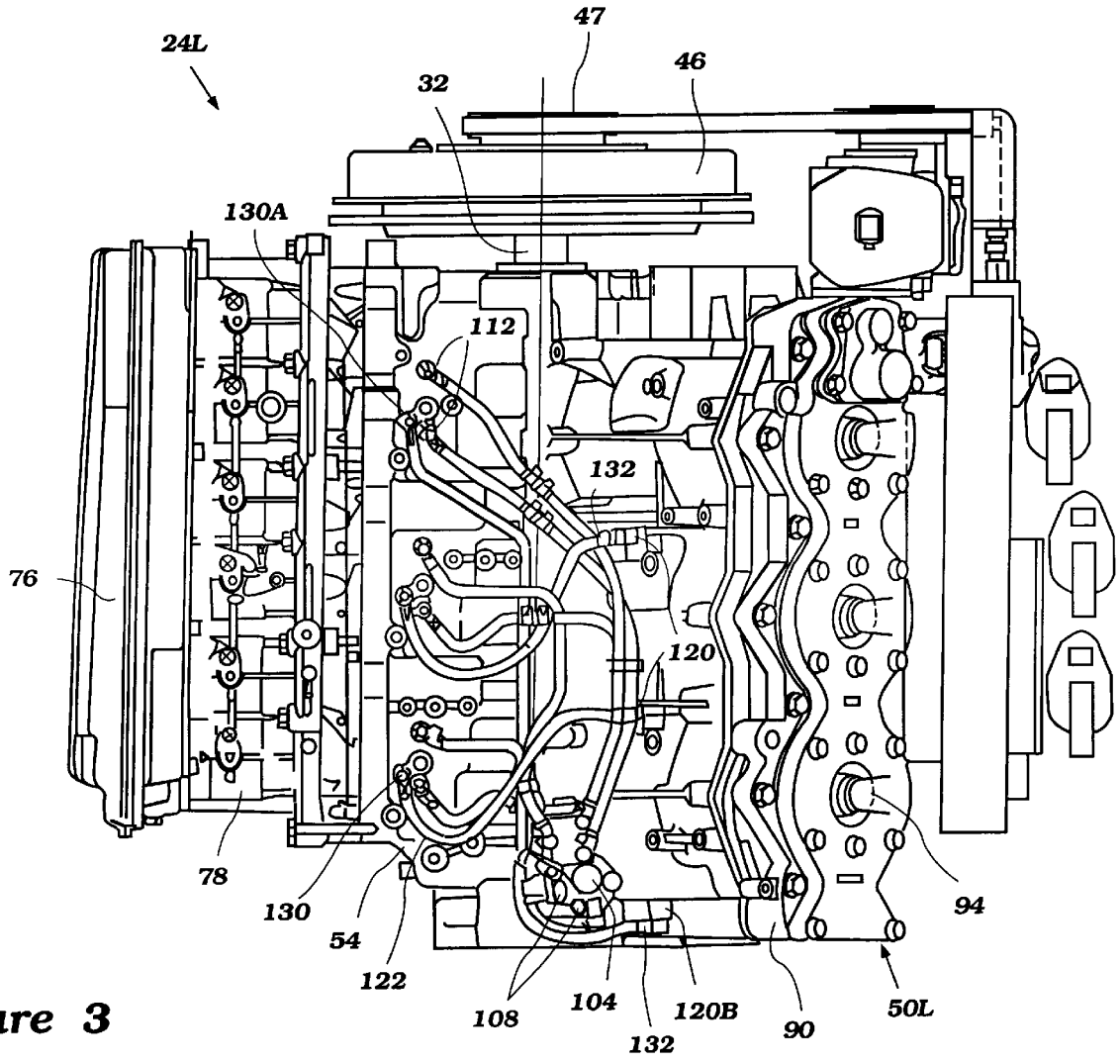
FIG. 3 is a left side view of the engine of FIG. 2.
Figure 4:
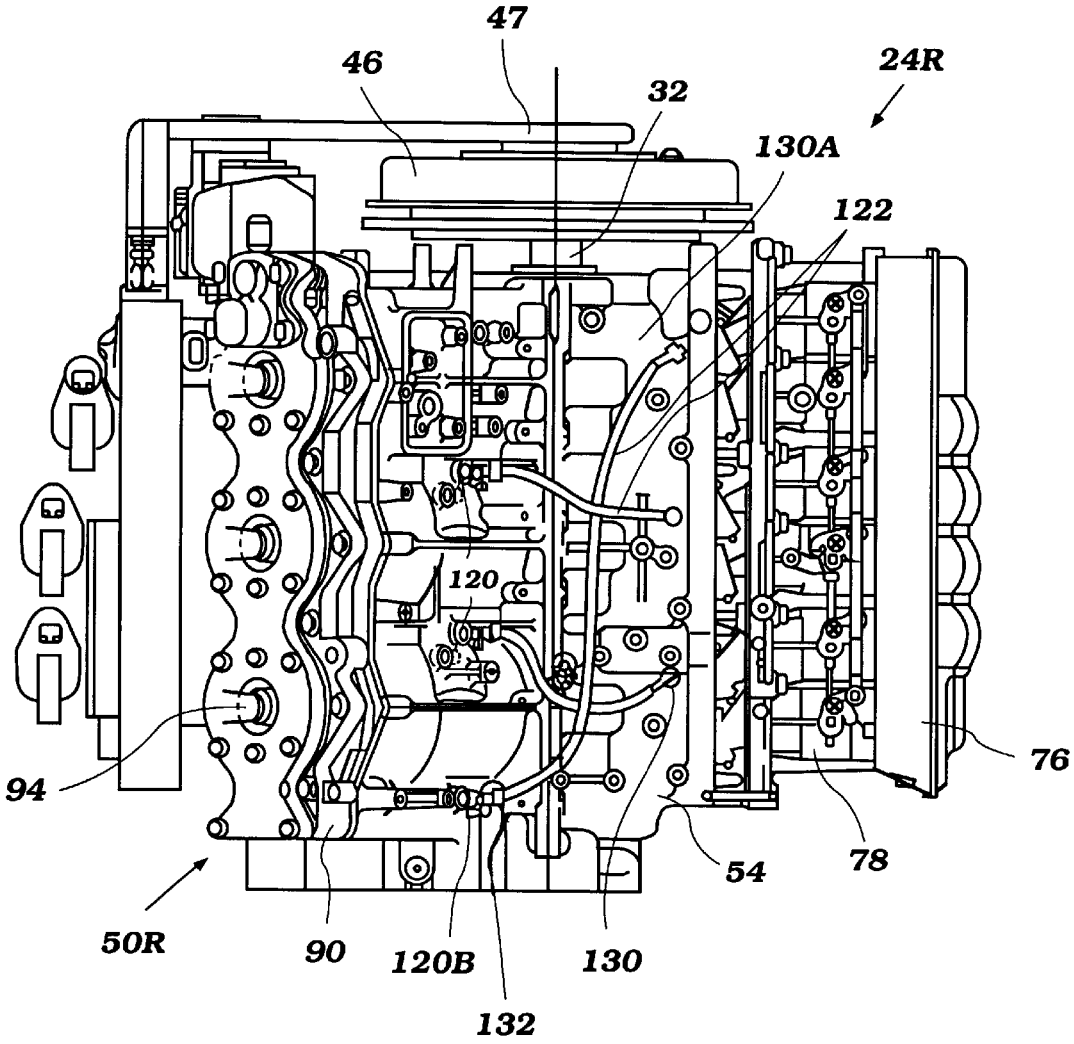
FIG. 4 is a right side view of the engine of the FIG. 2.
Figure 5:
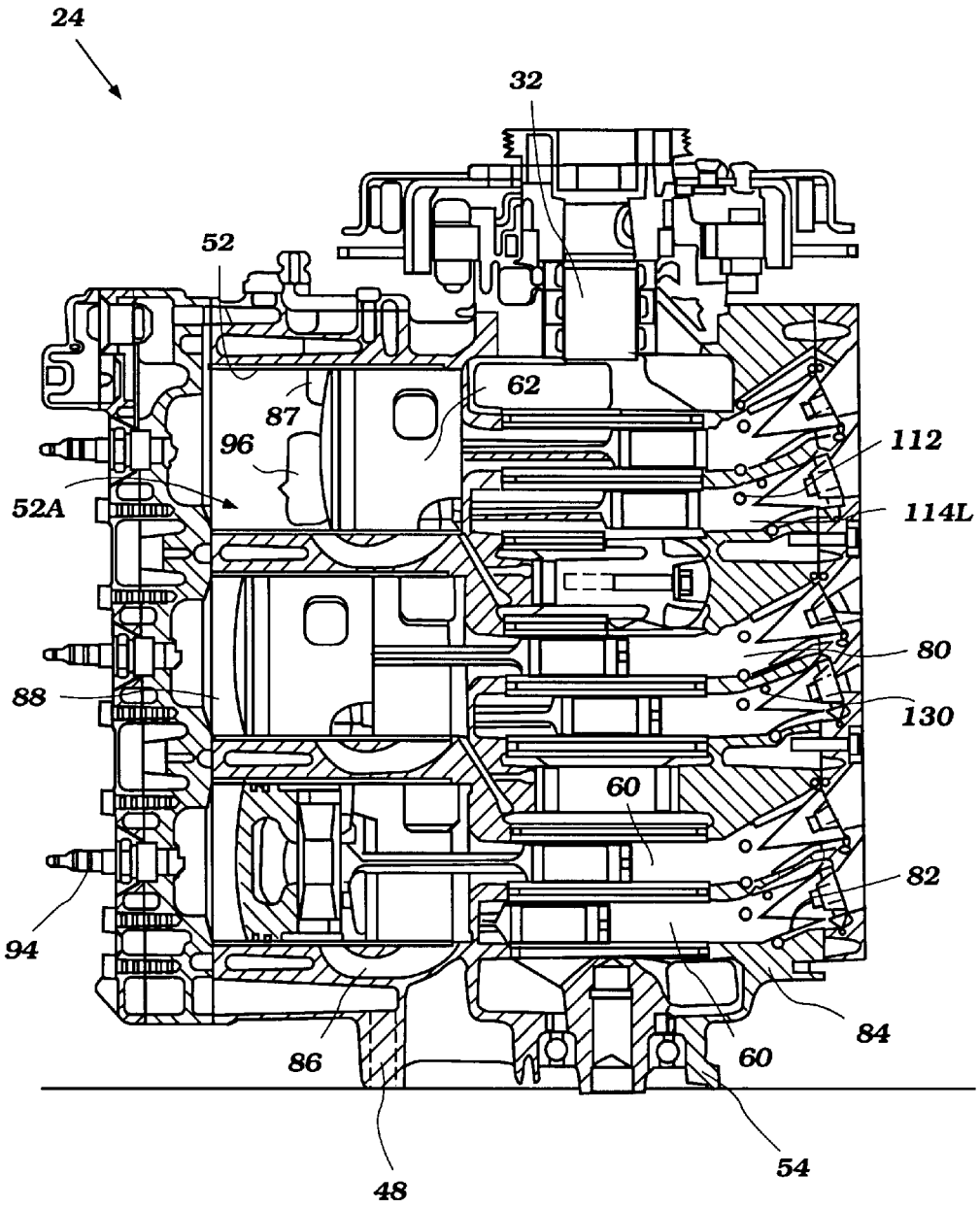
FIG. 5 is a cross-sectional view of the engine of FIG. 2 taken along line 5—5.

With next reference to FIG. 2, the internal combustion engine 24 is preferably of a V-6 type and operates on a two stroke crankcase compression principle. Although the invention may be employed in conjunction with engines operating on other combustion principles and cycles, it will be readily apparent to those skilled in the art that it has particular utility with two stroke engines because of the manners in which they are normally lubricated. It is to be understood that the actual number of cylinders and the cylinder configuration may vary. For example, an inline four cylinder engine or a single-cylinder engine may appropriately employ certain aspects of the invention. Also, various engine component arrangements may appropriately be employed in conjunction with the present invention. For example, although FIGS. 3–5 depict a flywheel 46 and pulley drive 47 positioned at the top of the engine 24, these components may appropriately be relocated to other positions, such as below the engine.

The V-6 engine 24 preferably has a right and left side 24R, 24L and includes a cylinder block 48 having a pair of angularly related cylinder banks 50L, 50R, each of which includes three cylinders 52 formed therein. As is typical with V-type engine practice, the cylinders in the cylinder banks are staggered. Thus, as shown in FIG. 5, the uppermost cylinder 52A of the right cylinder bank is oriented vertically higher than the uppermost cylinder of the left cylinder bank 50L.

The cylinder banks 50L, 5OR are attached to a central crankcase 54 which houses a substantially vertical crankshaft 32. The crankcase 54 is divided into crankcase chambers 60, one chamber corresponding to each of the cylinders 52. Each cylinder 52 includes a piston 62 supported within the cylinder and adapted for reciprocating movement. A piston ring 64 rotatably attaches the piston 62 to a small end 66 of a connecting rod 68. A large end 70 of the connecting rod 68 is journaled onto a throw 70 of the crankshaft 32. The crankshaft 32 and connecting rods 68 are preferably adapted so that the crankshaft 32 turns in a clockwise position as viewed from the top plan view. It is to be understood, however, that a counterclockwise direction may also be used in conjunction with an appropriate transmission.

Figure 7:
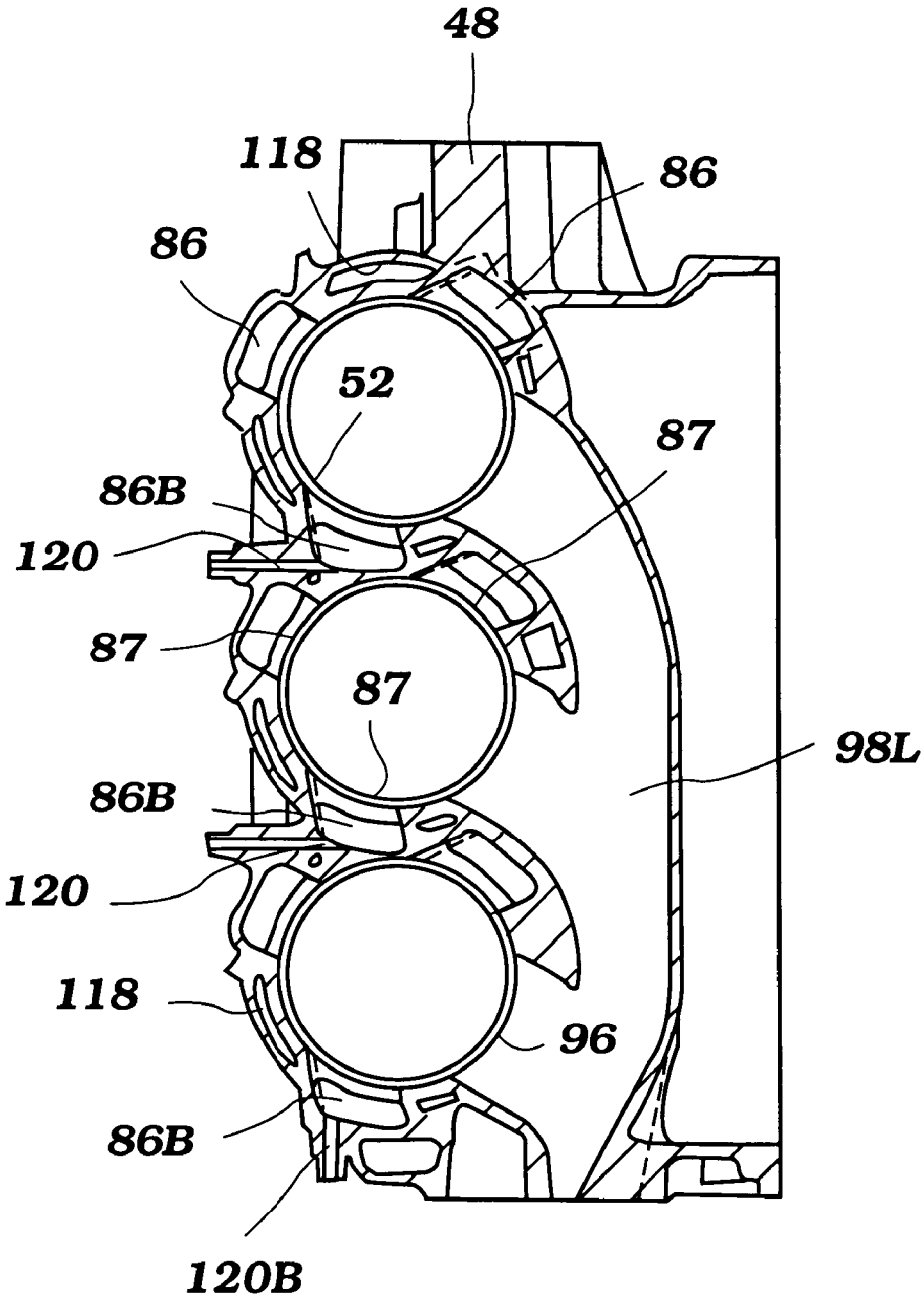
FIG. 7 is a cross-sectional view of the engine of FIG. 2 taken along line 7—7.
Figure 8:
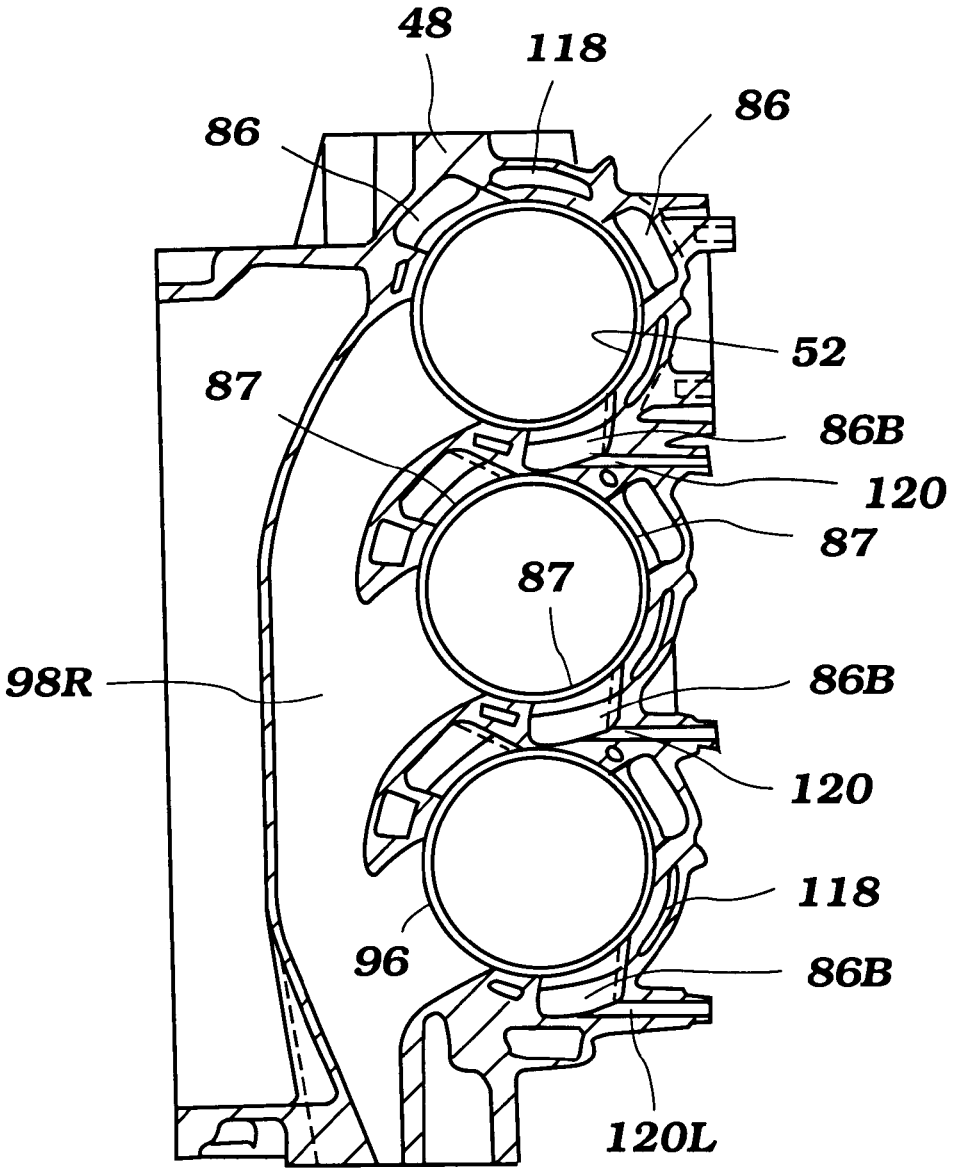
FIG. 8 is a cross-sectional view of the engine of FIG. 2 taken along line 8—8.

With next reference to FIGS. 7 and 8, each cylinder 52 preferably has a system of three scavenge passages 86 to conduct the air charge from the crankcase chamber 60 to the combustion chamber 88. Although the preferred embodiment uses three scavenge passages 86 per cylinder 52, it is to be understood that any suitable scavenge system with any number of scavenge passages per cylinder may be used in a manner known in the art. Coolant jackets 118 are preferably formed in the cylinder block 48 adjacent the cylinders 52 and are adapted to supply a flow of coolant around the cylinders to cool the cylinders.

With reference again to FIG. 2, an air charge is supplied to each individual crankcase chamber 60 by an induction system 74. The induction system 74 includes an air inlet device 76 that draws atmospheric air from the area within the protective cowling 26. A throttle body is 78 positioned in an air passage 80 and regulates the volume of air supplied. An air guide 84 is preferably integrally joined with the front side of the crankcase chamber 60. A valve 82 is positioned within the air guide downstream of the throttle body 78. Various valve types, such as rotary valves or reed valves, can suitably be employed for the valve 82, Most preferably, the valve 82 comprises a one-way valve. The air charge passes through the valve 82 to enter the crankcase chamber 60. Air from the chamber travels through scavenge passages 86 formed in the cylinder block 48, through scavenge ports 87 and into a combustion chamber 88 formed between the piston 62, cylinder walls and a cylinder head 90.

Fuel is preferably injected directly into the combustion chamber 88 by a fuel injector 92 in the cylinder head 90. Fuel is preferably supplied to the fuel injectors 92 by a fuel rail 100. The air/fuel mixture is preferably sparked and burned by a spark plug 94 also disposed in the cylinder head 90.

After combustion, the exhaust products exit the combustion chamber through an exhaust port 96. Each bank of cylinders 50L, 50R has a dedicated exhaust manifold 98L, 98R for receiving and directing the exhaust products from each cylinder 52 in the respective cylinder bank 50L, 50R.

A lubrication system is provided for lubricating the moving engine components. With next reference to FIGS. 2 and 3, the lubrication system includes a lubricant pump 104 preferably mounted on the left side 24L of the engine 24.

Figure 6:
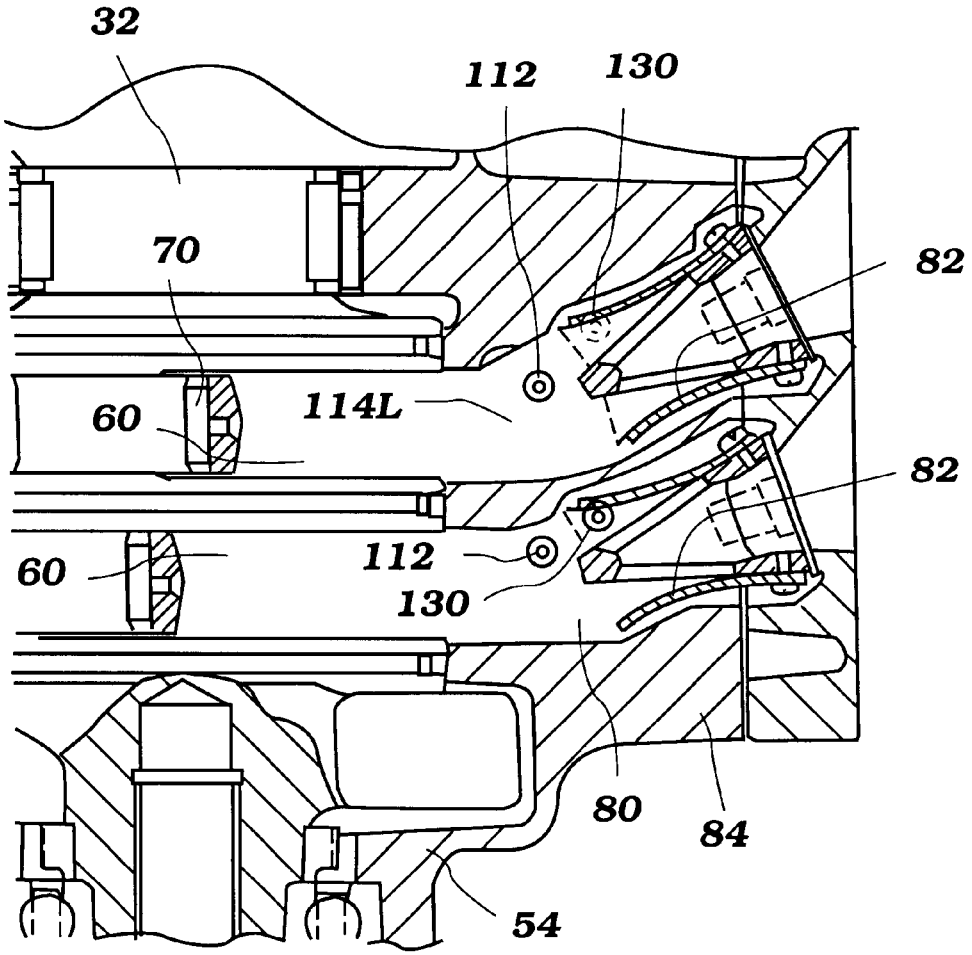
FIG. 6 is an enlarged view of portion of the engine as viewed in FIG. 5.

The pump 104 is connected to and draws lubricant from a source of lubricant such as an oil tank 106. The pump preferably 104 includes six ports 108, one corresponding to each crankcase chamber. Each port 108 is connected by a hose 110 to a lubricant insertion port 112 in the left wall 114L of the air guide 84 of each crankcase chamber 60. Also, each lubricant insertion port 112 preferably includes a tip 116 that extends into the air passage from the air guide wall 114L. The tip 116 preferably extends into the air passage a distance of about 5 to 20 mm and more preferably about 10 mm. As also shown in FIGS. 5 and 6, each lubricant insertion port 112 is preferably positioned downstream of the valve 82 and immediately adjacent the valve's downstream end. This arrangement enables the tip 116 to place the lubricant insertion port 112 directly in the air flow through the valve 82.

Positioning the lubricant insertion port 112 in the left wall 114L of the air guide 84 provides certain advantages in the engine of this embodiment. For example, as discussed above, the clockwise rotation of the crankshaft 32 tends to create a clockwise swirling air flow within the crankcase chamber 60. Thus, the lubricant insertion port 112 discharges lubricant in the same general direction as the air flow within the crankcase chamber 60. Additionally, the positioning of the lubricant insertion port 112 immediately downstream of the reed valves 82 takes advantage of the significant air flow through the reed valves 82. The combined effects of these air flows on the discharged oil is that the lubricant is caught up in the flow and is well distributed about the crankcase chamber 60, fully lubricating moving components such as the pistons 63 and connecting rods 68.

It is to be understood that lubricant can be inserted continuously or intermittently and still benefit from the advantages of the present invention. Also, the oil may be discharged as a linear injection, a spray or even a drip. Although it is preferable to have the tip 116 extend from the wall 114 of the air guide 84, placement of the lubricant insertion port 112 immediately downstream of the reed valves 82 is still beneficial even if the port discharges oil directly from an outlet in the wall 114.

Those of skill in the art will appreciate that alternative lubricant injection port orientations may also be beneficial in certain applications. For example, although the lubricant insertion port 112 is depicted extending in a direction substantially perpendicular to the air guide passage, the port may be oriented to be directed more toward the center of the crankcase. Also, although lubricant is preferably injected so as to flow downstream with the air flow within the crankcase chamber, the oil insertion port may be positioned on the right wall 114R of the air guide 84 so as to inject lubricant in a direction substantially opposite to the swirling air flow within the crankcase chamber 60.

The lowermost scavenging passage 86B of each cylinder 52 is preferably equipped with a drain port 120. As shown in FIGS. 3 and 4, each drain port 120 is preferably connected by a hose 122 to a return port 130. Lubricant in the scavenge passages 86 will tend to collect in the lowermost passage 86B about each cylinder. This collected lubricant flows through the drain port 120 and through the hose 122, being discharged into a crankcase chamber 60 through the return port 130. With reference again to FIGS. 2, 5 and 6, each return port 130 is preferably positioned in the wall 114 of the crankcase chamber's air guide 84 and near the lubricant insertion port 112.

Check valves 132 are preferably provided between the drain port 120 and return port 130. The check valves comprise one-way valves of any suitable type known in the art. In operation, the check valves allow lubricant from the scavenge passages 86 to flow by gravity, pressure pulses, or other means toward the crankcase chamber 60, but prevent flow in the opposite direction.

As will be appreciated, the cylinders 52 of the left bank 50L preferably drain to return ports 130 extending through the air guide left wall 114L and the cylinders of the right bank 50R preferably drain to return ports 130 extending through the air guide right wall 114R. Only the left wall 114L of the air guide 84 is shown in FIG. 5. Accordingly, only return ports 130 corresponding to cylinders in the left cylinder bank 50L are shown. FIG. 6 uses phantom lines to depict the position of the return port 130 corresponding to a cylinder in the right cylinder bank 50R. It is to be understood that any arrangement of drain ports may be used. For example, hoses may communicate lubricant from drain ports 120 in the right cylinder block 50R to return ports 130 through the left wall 114L of the air guide 84. Also, rather than hoses, the drain ports 120 and return ports 130 can be connected by passages formed through the cylinder block 48.

As shown in FIGS. 5 and 8, the lubricant insertion port 112 and lubricant return port 130 are preferably positioned near the top of the air guide wall 114 while the drain 120 is positioned at or near the lowest portion of the scavenge passages 86 surrounding the cylinder. Thus, the return port 130 of a given cylinder's crankcase chamber is generally vertically higher than the cylinder's drain port 120. To aid in the flow of lubricant from drain ports to return ports, and as shown in FIGS. 3 and 4, each drain port preferably communicates with the return port opening into the crankcase chamber of the vertically next lowest cylinder of the particular cylinder bank. Thus, gravity aids the flow of lubricant from the drain port to the return port. Also, because the drain port and return port communicate between different crankcase chambers, differential pressures between the chambers will, in effect, pump draining lubricant from the drain port to the corresponding return port.

Because there is no lubricant return port located below the lowermost drain port 120B, the lowermost drain port 120B is connected to a vertically higher lubricant return port 130, preferably the uppermost return port 130A. Although the crankcase chambers 60 are basically sealed from each other, condensed lubricant tends to seep downwardly to the lowermost chambers. Communicating lubricant from the lowest drain ports to return ports near the top of the engine helps prevent accumulation of lubricant in the bottom portions of the engine. In the preferred embodiment, the lowermost drain port 120B of each cylinder bank 50L, 50R communicates with the uppermost return port 130A of each cylinder bank 50L, 50R. It is to be understood that the above-described drain port/return port couplings may be rearranged in any acceptable manner. For example, return ports corresponding to drain ports in the left cylinder bank can discharge lubricant into crankcase chambers corresponding to cylinders of the right cylinder bank. Also, return ports may discharge lubricant into the lubricant tank 106 rather than into a crankcase chamber.

Furthermore, although in the illustrated embodiment the drain port 120 of each cylinder's lowermost scavenge passage 86B communicates with a return port 130 in a crankcase chamber 60 associated with a different cylinder 52, it is to be understood that drain ports can communicate with return ports opening into the same cylinder's corresponding crankcase chamber. Thus, the present invention can be used not only for multi-cylinder engines, but also for single cylinder engines.

With reference again to FIGS. 7 and 8, the drain ports 120 typically are formed within the cylinder block 48 and extend substantially horizontally from their corresponding scavenge passages 86. As shown in FIG. 7, the lowermost drain port 120B can project substantially downwardly rather than horizontally. It is to be understood that drain ports may be oriented in any direction convenient for the organization of the engine. For example, FIG. 3 shows that the orientation of the vertically-extending lowermost drain port 120B prevents the port from interfering with the mounting of the mechanical lubrication pump 104.

The above-discussed embodiments provide a number of advantages. For example, the arrangement of the lubrication insertion ports 112 in the manner discussed above allows lubricant having a relatively high viscosity to take advantage of air flow in order to achieve even and full distribution to engine components. Thus, lubrication is improved, especially in fuel injected two cycle engines.

The drain ports and return ports help prevent lubricant from entering the combustion chamber. Thus, the engine runs cleaner, emitting less hydrocarbons. Another advantage is that less lubricant is wasted by being burned and exhausted. Arranging the lowermost drain ports 120B to communicate with the uppermost return ports 130A prevents lubricant accumulation in the lowermost crankcase chambers of the engine. This arrangement also ensures that lubricant seeping from the uppermost chambers is replenished. Thus, lubricant is more evenly distributed about the engine.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An internal combustion engine having at least one variable volume combustion chamber, the combustion chamber being defined by at least a pair of components that move relative to each other, and a crankcase enclosing a crankshaft therein and having an air guide, the crankshaft being connected to one of the combustion chamber components, the air guide communicating with an air inlet device through a valve that regulates air flow into the crankcase, the air guide further having a lubricant insertion port immediately adjacent a downstream side of the valve.

2. The internal combustion engine of claim 1, wherein the lubricant insertion port communicates with a pump and a source of lubricant, and is adapted to discharge lubricant into the crankcase.

3. The internal combustion engine of claim 1, wherein the crankshaft is journalled within the crankcase to rotate about an axis, and the lubricant insertion port is adapted to discharge lubricant into a circulating air stream created by the rotating crankshaft.

4. The internal combustion engine of claim 3, wherein the lubricant insertion port is adapted to discharge lubricant generally in a direction coincident with a rotational direction of the crankshaft.

5. The internal combustion engine of claim 1 additionally comprising a lubrication delivery tip extending inwardly from a wall of the air guide, and the lubricant insertion port is formed through the tip.

6. The internal combustion engine of claim 5, wherein the tip extends into a flow path of air passing through the valve.

7. The internal combustion engine of claim 1, including a fuel injector adapted to spray fuel directly into the combustion chamber.

8. The internal combustion engine of claim 1, wherein the crankcase communicates with the combustion chamber through at least one scavenge passage, and the scavenge passage includes a drain communicating with a return port, the return port opening into the crankcase.

9. The internal combustion engine of claim 8, wherein the drain is positioned vertically higher than the corresponding return port.

10. The internal combustion engine of claim 9, wherein the crankcase is divided into at least first and second crankcase chambers, the first chamber communicating with a first combustion chamber through a first scavenge passage and the second crankcase chamber communicating with a second combustion chamber through a second scavenge passage, and the drain is positioned in the first scavenge passage and the return port opens into the second crankcase chamber.

11. The internal combustion engine of claim 1, wherein the engine comprises a plurality of horizontally-disposed cylinders and the crankcase is divided into a plurality of crankcase chambers, each crankcase chamber communicating with one of the cylinders through at least one scavenge passage.

12. An internal combustion engine having at least one variable volume combustion chamber, the combustion chamber being defined by at least a pair of components that move relative to each other, and a crankcase enclosing a crankshaft therein and having an air guide, the air guide communicating with an air inlet device through a valve that regulates air flow into the crankcase, the crankcase including a means for inserting lubricant immediately adjacent a downstream side of the valve and a means for distributing lubricant in the crankcase.

13. The internal combustion engine of claim 12, wherein the inserting means communicates with a pump and a lubricant source.

14. The internal combustion engine of claim 12, wherein the inserting means is adapted to insert lubricant in a flow of air through the valve.

15. The internal combustion engine of claim 12, including a fuel injector adapted to spray fuel directly into the combustion chamber.

16. The internal combustion engine of claim 15, wherein the engine comprises a plurality of horizontally-disposed cylinders and the crankcase is divided into a plurality of crankcase chambers, each crankcase chamber communicating with one of the cylinders through at least one scavenge passage.

17. The internal combustion engine of claim 16, including means for draining lubricant that accumulates in the scavenge passages.

18. The internal combustion engine of claim 16, including means for distributing lubricant between crankshaft chambers.

19. An internal combustion engine having at least one variable volume combustion chamber, the combustion chamber being defined by at least a pair of components that move relative to each other, a crankcase enclosing a crankshaft therein and having an air guide, the crankshaft connected to one of the combustion chamber components, the air guide communicating with an air inlet device and adapted to conduct a flow of air into the crankcase, and a scavenge system adapted to supply air from the crankcase to the combustion chamber, the scavenge system including a drain port adapted to communicate lubricant away from the scavenge system.

20. The engine of claim 19, including at least one fuel injector adapted to directly inject fuel into the combustion chamber.

21. The engine of claim 19, wherein the drain port communicates with a lubricant return port adapted to insert lubricant into the crankcase.

22. The engine of claim 21, including at least one check valve between the drain and the return port.

23. The engine of claim 22, wherein the drain port is positioned vertically higher than the return port.

24. The engine of claim 21, including a valve for regulating air flow through the air guide into the crankcase, and the return port is positioned on a downstream side of the valve.

25. The engine of claim 24, including a lubricant insertion port communicating with a source of lubricant and adapted to insert lubricant into the crankcase, and the lubricant insertion port is positioned immediately adjacent the downstream side of the valve.

26. The engine of claim 19, wherein the crankcase is divided into at least first and second crankcase chambers, the first crankcase chamber communicating with a first combustion chamber through a first scavenge passage and the second crankcase chamber communicating with a second combustion chamber through a second scavenge passage, and the drain is positioned in the first scavenge passage and the return port opens into the second crankcase chamber.

27. The engine of claim 26, including a second drain positioned in the second scavenge passage and communicating with a second return port, and the second return port opens into a third crankcase chamber.

28. The engine of claim 27, wherein the crankshaft rotates about a substantially vertical axis, and the first crankcase chamber is positioned vertically above the second crankcase chamber and the third crankcase chamber is positioned vertically above the first crankcase chamber.

29. The engine of claim 19, including a first cylinder formed in a first cylinder bank and a second cylinder formed in a second cylinder bank, the cylinder banks oriented in a V-shaped formation relative to each other, the first cylinder having a first scavenge passage with a first drain port communicating with a first return port which is adapted to deliver lubricant into the crankcase, and the second cylinder having a second scavenge passage with a second drain port communicating with a second return port which is adapted to deliver lubricant into the crankcase, and the first and second return ports are on opposite sides of the crankcase.

30. An internal combustion engine having at least one variable volume combustion chamber, the combustion chamber being defined by at least a pair of components that move relative to each other, a crankcase enclosing a crankshaft therein and having an air guide, the air guide communicating with an air inlet device and adapted to conduct a flow of air into the crankcase, a scavenge system adapted to supply air from the crankcase to the combustion chamber, and means for conducting lubricant away from the scavenge system.

31. The engine of claim 30, including at least one fuel injector adapted to directly inject fuel into the combustion chamber.

32. The engine of claim 30, wherein the conducting means communicates with the crankcase.

33. The engine of claim 32, wherein the conducting means includes at least one check valve.

34. The engine of claim 32, wherein the conducting means communicates with a lubricant return port adapted to insert lubricant into the crankcase.

35. The engine of claim 34, including a valve for regulating air flow through the air guide into the crankcase, and the return port is positioned on a downstream side of the valve.

36. The engine of claim 30, wherein the crankcase is divided into a plurality of crankcase chambers, and the engine includes means for distributing lubricant between the crankcase chambers.

37. The internal combustion engine of claim 30, wherein the engine comprises a plurality of horizontally-disposed cylinders and the crankcase is divided into a plurality of crankcase chambers, each crankcase chamber communicating with one of the cylinders through at least one scavenge passage.

38. The internal combustion engine of claim 37, including means for distributing lubricant between crankshaft chambers.

* * * * *